US005343635A

United States Patent [19]

Nguyen

[11] Patent Number: 5,343,635

[45] Date of Patent: Sep. 6, 1994

[54] INCREASED CAPACITY DISC DRYER

[75] Inventor: Lam T. Nguyen, Lancaster, Pa.

[73] Assignee: Aggregates Equipment, Inc., Leola, Pa.

[21] Appl. No.: 160,228

[22] Filed: Dec. 2, 1993

Related U.S. Application Data

[62] Division of Ser. No. 901,947, Jun. 22, 1992, Pat. No. 5,271,165.

[51] Int. Cl.[5] ..... F26B 9/00

[52] U.S. Cl. ..... 34/164; 209/365.1; 209/445; 209/452; 210/520; 210/523

[58] Field of Search ..... 34/164, 174, 168, 167; 209/452, 451, 365.1, 309, 350, 351, 445; 210/144, 520, 523, 513

[56] References Cited

U.S. PATENT DOCUMENTS

| | | | |
|---|---|---|---|
| 2,899,070 | 8/1959 | Murphy | 210/523 |
| 3,058,235 | 10/1962 | Morris et al. | 34/164 |
| 3,291,304 | 12/1966 | Fuchs | 209/452 |
| 4,522,711 | 6/1985 | Cleland | 209/452 |

*Primary Examiner*—Denise Gromada
*Attorney, Agent, or Firm*—Martin Fruitman

[57] ABSTRACT

An improved disc dryer for aggregate material which operates by rotating and impacting a tilted pan which holds the material being dried. Increased capacity is attained by transverse stabilizers on the impactor assembly, adjustable pressure air shock mounts for variable amplitude control of the impactor assembly, sets of dual support wheels upon which the pan rotates a reinforced support tract on the underside of the pan, and an adjustable feed box for supplying material to the pan at varying locations.

2 Claims, 3 Drawing Sheets

INCREASED CAPACITY DISC DRYER

This is a division of application Ser. No. 07/901,947 filed Jun. 22, 1992, now U.S. Pat. No. 5,271,165.

SUMMARY OF THE INVENTION

This invention deals generally with classifiers and dehydrators for aggregate materials, and more specifically with a tilted disc type dryer for fines such as sand and gravel.

The tilted disc dryer is known in the art. It consists essentially of a pan-like disc with relatively low retainer sides, with its bottom tilted to the horizontal, which is rotated slowly, of the order of three revolutions per minute, as it is also impacted. Wet material is delivered to the disc near its lowest edge, typically by a simple gravity chute, and as the rotation of the pan moves the material to the higher region of the pan, the liquid drains out of the material and remains in the lower region.

The draining liquid remains in the lower region of the pan, and, as it accumulates and exceeds the height of the lip at the lowest part of the sides, it spills out, so that a continuously operating dryer always has liquid flowing over the edge at its lowest point.

The dried material is continuously unloaded through a central hole in the disc, to which it is directed by a deflector of spiral configuration which catches the material high on the rotating disc and deflects it toward the central hole as the bottom disc of the pan attempts to move it around.

The mechanism for rotation in such an apparatus typically consists of several support wheels located at widely spaced positions around and under the pan, upon which the pan bottom rotates as it is powered by a motor which drives a ring gear attached to the under surface of the pan.

A vibrating motion is developed in the pan by impacting the pan with a separate impactor assembly as the pan is rotated. A vibration motor vibrates the impactor assembly relative to a fixed support frame, and wheels at the top of the impactor assembly repeatedly strike the bottom of the pan. Wheels are used as the impact members because the pan is constantly rotating. The interconnection between the fixed support frame and the impactor assembly is accomplished by distortable support members, such as rubber pads, which anchor the impactor assembly to the support frame while still permitting the impactor assembly to vibrate relative to the fixed support frame and thus strike the bottom of the pan.

A major limitation on this type of dryer to date, however, has been its limited capacity. Increased capacity requires both larger and heavier apparatus and also increased weight of the material in the pan at any time, and the difficulty in supporting this increased weight at an angle to the horizontal, which also impacting the pan, has limited the size and capacity of such dryers. Since the weight of the rotating assembly must be supported on an inclined plane by the support wheels and induced into vibration by the impactor assembly, the increased weight causes increased stress and accelerated failure of these parts.

The present invention solves the problem of increased capacity in disc dryers by improving several parts of the machine, each of the changes providing an incremental increase in dryer capacity, and all of them together providing a substantial increase in capacity.

One of these improvements is providing a variable control for the amplitude of the impactor assembly. In the present invention, the old style rubber pads have been replaced by controllable inflated air shock mounts. All of these air shock mounts in one dryer are connected to a common pressure regulating system and can therefore be increased or decreased in pressure to stiffen or soften them. Such variation in the air pressure of the inflatable shock mounts varies the amplitude of the vibration of the impactor assembly and provides a control for the intensity of impact to which the pan is subjected.

Another improvement helps prevent the rotation of the pan from reacting back against the impactor assembly and distorting the support members in a direction parallel to the bottom of the pan. This is accomplished by the addition of one or more transverse stabilizers, distortable shock mounts to share the transverse load caused by the transfer to the impactor assembly of the vector force of the machine and material weight acting down the inclined plane of the disc pan. These additional stabilizers can be any resilient members, but in the preferred embodiment of the invention each is a particularly stiff structure which resembles a piston filled with rubber.

Another improvement in the preferred embodiment is the substitution of dual sets of wheels for the usual single wheels supporting the lower half of the pan. In order to relieve the extra load of increased machine capacity, at least one set of two wheels, each set associated together on a single pivoting assembly, is located in contact with the lower half of the underside of the pan to divide the load between them.

This increased load, however, affects more than just the wheels. The surface on the underside of the pan which is supported by the wheels is likewise subjected to increased load as the machine capacity increases. To avoid problems with the underside of the pan and to provide a smooth surface for the wheels to contact, a specially designed track is installed on the underside of the pan for the wheels to contact. This tract is essentially a channel cross section with the open side of the channel welded to the underside of the pan and the outside surface of the web of the channel acting as an elevated track for the wheels. Of course, the track is laid out in a circular path on the underside of the pan.

A still further improvement for disc dryers furnished by the preferred embodiment of the invention is a feed box which includes an adjustment for the location at which the pan is fed. Varying the input location of the material to the pan permits the feed box to be used to control the degree of drying. This adjustable input location is attained by the use of telescoping sections on the feed box. The lower section fits around the upper box section, and the lower section is both supported by and adjustable in its distance below the upper section and above the disc dryer pan by the use of four threaded studs located on the outside of both the upper and lower sections.

The feed box also attains greater versatility by having a rotatable lower spout. Its hopper style bottom includes an opening in only one of the surfaces which is angled to the horizontal and is off center. Thus, rotation of the box lower section can direct the feed out into any one limited segment of an essentially circular area. This provides further versatility for the dryer itself because, along with the adjustment of the height of the feed box output above the pan, it permits further variation of the location of material feed to the dryer, which can be used to control the degree of drying to which the material is subjected.

The several improvements to disc dryers furnished by the present invention therefore not only yield a dryer with greater output capacity, but also furnish a dryer in which the drying action can be controlled without changing the disc rotation speed which also affects the production of the machine.

DETAILED DESCRIPTION OF THE INVENTION

Figure 1:
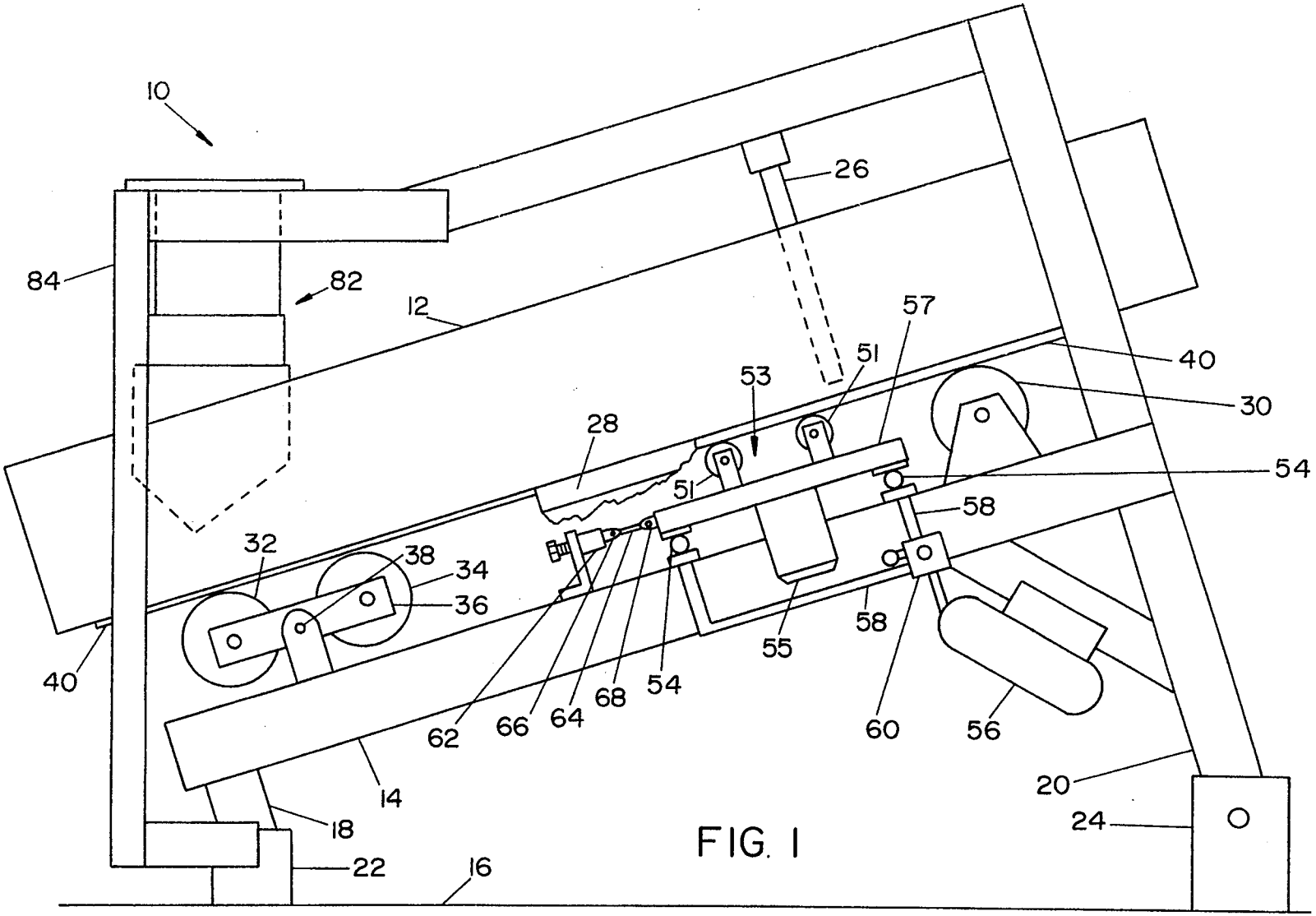
FIG. 1 is a side view of the disc dryer of the preferred embodiment.

FIG. 1 is a side view of the preferred embodiment of the invention in which disc dryer 10 is constructed of tilted pan 12 which is supported by support frame 14. Support frame 14 is held in its tilted position by legs 18 and 20 which are attached to base structure 16 by anchors 22 and 24.

Pan 12 is typically held in its tilted position by several wheels (not shown) which are positioned in the plane of pan 12 and located equidistant from the axis of pan 12 on the underside of pan 12. These wheels ride against a circular ring (not shown) and thus support pan 12 in its tilted position as it is rotated. The rotation of pan 12 is accomplished by means of a ring gear (not shown) which is attached to the underside of pan 12 and driven by a conventionally geared motor (not shown). The support and rotation structure described above is a conventional part of the prior art and is not considered a part of the present invention.

Another conventional part which is shown in FIG. 1 is spiral deflector 26. This device deflects the dried material in the bottom on pan 12 into a central opening of pan 12 from which it enters chute 28 for loading into some other trailsport or storage device (not shown).

Pan 12 is vertically supported by another group of wheels of which three are shown. These wheels support the underside of pan 12 which rotates upon them. Single wheel 30 is of conventional design and is typical of what has previously been available. However, wheels 32 and 34 are a unique configuration for disc dryers.

In order to enable a disc dryer to have a greater output capacity, its ability to handle weight must be increased, and a vital part of this increase comes from the support of the wheels beneath the pan. In the preferred embodiment of the invention this extra support is furnished by wheels 32 and 34 which are interconnected by dolly 36. Dolly 36 is pivoted on pivot pin 38 to assure that wheels 32 and 34 will remain in contact with the underside of pan 12 regardless of the rotation and vibration to which pan 12 is subjected. It should be noted that only the wheels associated with the lower half of the pan need to be increased in load handling capacity, since the material being dried remains essentially in the lower portion of pan 12.

Merely increasing the load capability of wheels 32 and 34 is, however, of itself not sufficient to strengthen disc dryer 10 because the forces to which the wheels are subjected are also applied to the underside of pan 12. A strengthening structure is therefore added to pan 12 in the form of a circular track 40 on the underside of the pan. Track 40 has a particular configuration to give it strength and to permit reliable manufacture.

Figure 2:
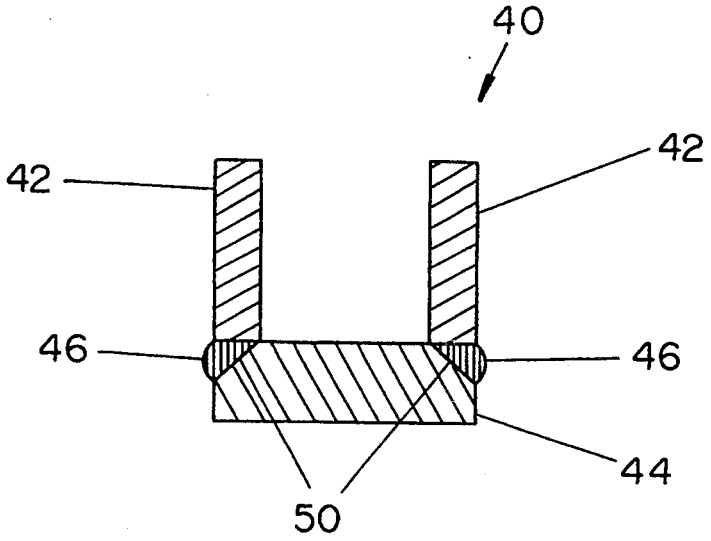
FIG. 2 is a cross section view of the support tract on the underside of the dryer pan.

As shown in FIG. 2, track 40 is constructed of only three parts. The two parallel parts, legs 42, are welded to transverse web 44 at welds 46. However, the shape of web 44 is made specifically to both permit a complete weld and also to withstand the compression loading required when it is located on the underside of the pan. Web 44 is therefore shaped with chamfers 50 which end approximately at the inner edges of legs 42. This permits access to the innermost region of the junction between the pieces during welding, but nevertheless places web 44 in contact with the bottoms of legs 44 so that, unlike the situation if it were between the legs, it is supported by them when channel 40 is loaded in compression.

The problems of increasing the strength of the pan and its associated motive parts are not the only ones encountered in increasing the load capacity of a disc dryer. An important function of the typical disc dryer is that, in order to set up vibrations in the pan and the material within the pan, it also impacts the pan as it rotates it. This motion becomes much more difficult as the dryer capacity is increased, not only because it requires more power and larger motors, but also because of the stresses upon the impactor assembly.

As shown in FIG. 1, pan 12 rests not only on wheels 30, 32 and 34, but also on wheels 51 of impactor assembly 53. Impactor assembly 53 is vibrated by vibration motor 55, which is attached to impactor base plate 57, and as impactor assembly 53 vibrates, wheels 51 continually strike the underside of pan 12. It is the repeated impact of wheels 51 which induce vibrations in pan 12 and the material within palm 12.

It is quite apparent that in order for impactor assembly 53 to vibrate and strike pan 12, impactor assembly 53 must be attached to support frame 14 with a resilient system, and, typically, simple rubber pads have been used. However, the present invention makes use of this resilient support system to provide a new control for the intensity of the impacts to which pan 12 is subjected. To accomplish this, base plate 57 is attached to support frame 14 with inflatable air shock mounts 54. Therefore, as the inflation pressure of shock mounts 54 is varied, the amplitude of the vibration of impactor assembly 53 varies, and the impact against pan 12 also varies. By this means a dimension of control of the disc dryer is attained which has never before been available. Although only two air inflatable shock mounts 54 are seen in FIG. 1, there are generally more needed to furnish the required support for impactor assembly 53.

It should be appreciated that, unlike many other shock mount applications, the tilted orientation and rotation of pan 12, acting through wheels 51, apply a considerable force on shock mounts 54 which is transverse to the force for which they have been designed. This is because of the tilted orientation of the pan and impactor assembly 53 itself and the sidewise vector force the weight and motion of the pan and its material create. This vector causes a shear stress on shock mounts 54 to which few such devices can accommodate.

The air inflatable shock mounts used in the preferred embodiment are, however, more suitable for such use because the air inflation permits increasing their stiffness with increased capacity of the dryer while permitting softer support for lighter loads.

Shock mounts 54 are supplied with compressed air from tank 56 through air lines 58 and air controller 60. Air controller 60 is manually adjusted to change the air pressure within all of the shock mounts 54 when different weight material is loaded into disc dryer 10 or when variation of the impactor amplitude is desired.

In order to supply even greater transverse support for impactor assembly 53, at least one transverse stabilizer 62 is also attached between impactor assembly 53 and the fixed support structure of the disc dryer by means of link 64 with pivots 66 and 68 at its opposite ends. Although stabilizer 62 could be any distortable structure, including additional air inflated shock mounts, for superior stiffness a special device is used.

Figure 3:
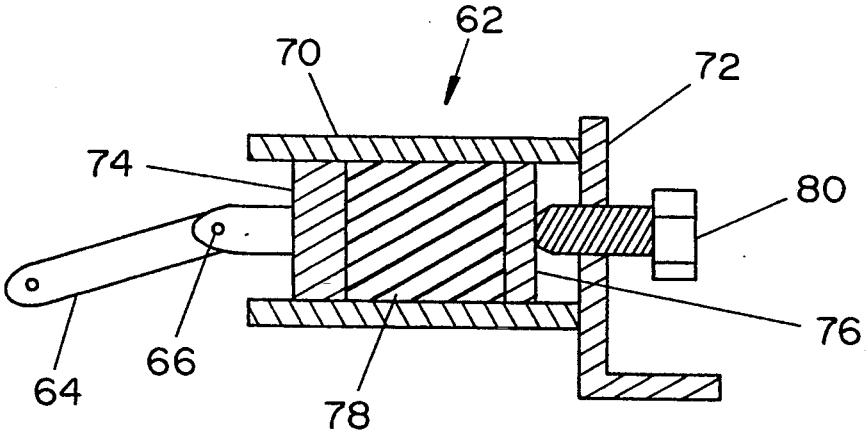
FIG. 3 is a cross section view of the transverse stabilizer used in the preferred embodiment.

As shown in FIG. 3, stabilizer 62 is essentially constructed as a rubber filled piston. Casing 70 is attached to angle 72 which is used to attach stabilizer 62 to support structure 14 of disc dryer 10. Casing 70, which is filled with a solid piece of rubber 78, and two movable end fittings 74 and 76 located within casing 70 on either side of rubber piece 78 complete the enclosure. Any force applied to link 64 in the direction toward stabilizer 62 will therefore be absorbed by rubber piece 78. The stiffness of stabilizer 62 is also adjustable by bolt 80 which is threaded through angle 72. As bolt 80 is threaded into stabilizer 62, it tightens upon rubber piece 78 causing it to stiffen its resistance to compression from end piece 74.

In combination or separately, the dual wheel configuration, the channel structure track, the air inflatable shock mounts, and the transverse stabilizer all add to the ability of a disc dryer to handle added load capacity.

The preferred embodiment of the invention also includes another feature which provides added versatility and control to disc dryer 10. Feed box 82, supported by upright 84, is used to control the quantity, location and direction of material fed to pan 14 for drying.

Figure 4:
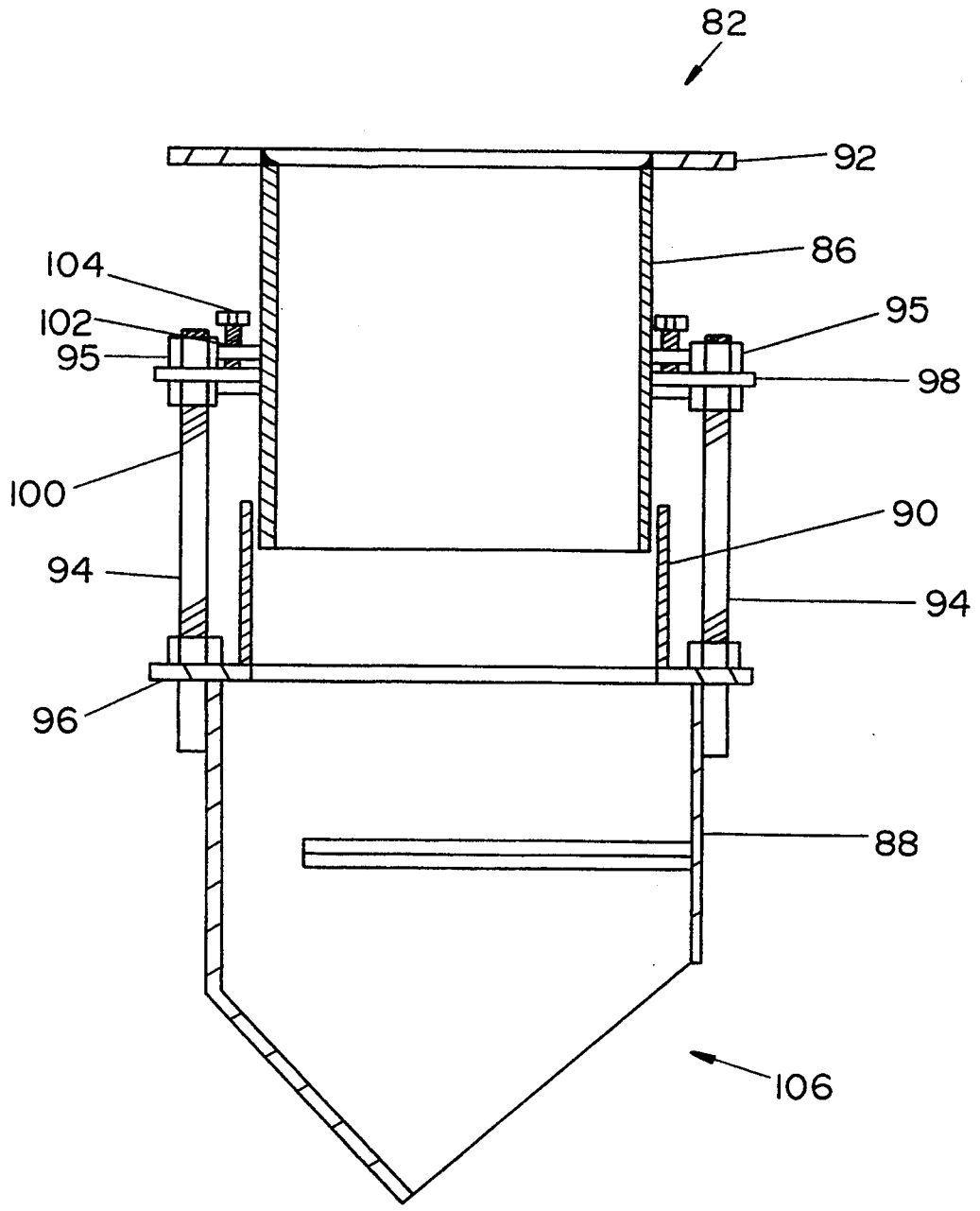
FIG. 4 is a cross section view of the feed box of the preferred embodiment.

As shown in FIG. 4, feed box 82 is essentially constructed of upper section 86 and lower section 88, with upper section 86 fitted within extension 90 of lower section 88. As seen in FIG. 1, feed box 82 is actually hung above pan 12 and supported from its top flange 92. Lower section 88 is then hung from upper section 86 by threaded studs 94, the lower ends of which are attached to flange 96 of lower section 88. Studs 94 are themselves hung from support flange 98 by their associated nuts 95, and support flange 98 is rotatably attached to upper section 86 by being supported upon flange 100.

Flange 100 is rigidly attached to upper section 86, while flange 98 is free to rotate around upper section 86. Flange 98 is, however, captured between flange 100, which supports it, and flange 102, which is also rigidly attached to upper section 86 above flange 98. Bolts 104, which are threaded through flange 102 are screwed tightly down upon flange 98 to lock it in a selected location.

Lower section 88 can therefore not only be raised and lowered, but can also be rotated about its axis, so that material exit 106 can be directed around a full circular area. This rotation actually provides a considerable adjustment for the location of the point of entry of material into disc dryer 10, since, as can be seen in FIG. 1, it permits feeding material anywhere from very close to the bottom corner of pan 12 to a location almost half the distance to the central exit hole. This distance can be increased even further as lower section 88 of feed box 82 is raised to increase the length of the trajectory of the material entering pan 12.

This adjustment of the entry point is a distinct advantage as the capacity of a disc dryer is varied. Without a variable entry location, the major controls available for the dryness of the output material are the speed of rotation of the pan and the degree of the impact imparted to the pan, but these parameters also affect the quantity of material being processed by the dryer. However, with the addition of the variable entry location made available by the feed box of the present invention, there is now available a means of varying the dryness of the output material which is independent of the speed of rotation and the quantity of material dried.

The present invention therefore furnishes a versatile, high capacity disc dryer with control of its drying function which has not previously been available.

It is to be understood that the form of this invention as shown is merely a preferred embodiment. Various changes may be made in the function and arrangements of parts; equivalent means may be substituted for those illustrated and described; and certain features may be used independently from others without departing from the spirit and scope of the invention as defined in the following claims.

What is claimed as new and for which Letters Patent of the United States are desired to be secured is:

1. In a dryer for aggregate materials of the type comprising a pan with retainer sides, the pan being oriented at an angle to the horizontal, being rotated upon wheels by which it is supported and being impacted by an impactor assembly to induce vibration, the improvement comprising:

a feed box for supplying material to the pan, the feed box including a material exit means which provides the material leaving the feed box with some horizontal motion so that the material does not fall directly below the feed box, and further including means to rotate the material exit means around the center axis of the feed box so that rotation of the material exit means moves the location of material entry into the pan.

2. The dryer of claim 1 further including means to increase the height of the material exit means above the pan.

* * * * *